US011123842B2

(12) United States Patent
Ferrari

(10) Patent No.: US 11,123,842 B2
(45) Date of Patent: Sep. 21, 2021

(54) PROCESS FOR MAKING A DIAMOND TOOL

(71) Applicant: DELLAS S.P.A., Lugo di Grezzana (IT)

(72) Inventor: Daniele Ferrari, Lugo di Grezzana (IT)

(73) Assignee: DELLAS S.P.A., Lugo di Grezzana (IT)

( * ) Notice: Subject to any disclaimer, the term of this patent is extended or adjusted under 35 U.S.C. 154(b) by 0 days.

(21) Appl. No.: 16/634,393

(22) PCT Filed: Jul. 25, 2018

(86) PCT No.: PCT/IB2018/055554
§ 371 (c)(1),
(2) Date: Jan. 27, 2020

(87) PCT Pub. No.: WO2019/021214
PCT Pub. Date: Jan. 31, 2019

(65) Prior Publication Data

US 2020/0376627 A1 Dec. 3, 2020

(30) Foreign Application Priority Data

Jul. 26, 2017 (IT) ..... 102017000085398

(51) Int. Cl.

| | |
|---|---|
| ***B24D 3/10*** | (2006.01) |
| ***B24D 3/00*** | (2006.01) |
| ***B24D 3/34*** | (2006.01) |
| ***B24D 7/00*** | (2006.01) |
| ***B24D 18/00*** | (2006.01) |

(52) U.S. Cl.
CPC ..... *B24D 3/10* (2013.01); *B24D 3/007* (2013.01); *B24D 3/342* (2013.01); *B24D 3/346* (2013.01); *B24D 7/00* (2013.01); *B24D 18/0009* (2013.01)

(58) Field of Classification Search
CPC .. B24D 18/00; B24D 18/0009; B24D 11/001; B24D 3/06; B24D 3/28; B24D 11/00; B24D 11/02; B24D 3/002; B24D 3/32; B24D 11/005; B24D 11/008; B24D 11/04; B24D 18/0072; B24D 2203/00; B24D 3/18; B24D 3/20; B24D 3/26; B24D 5/04; B24D 7/06; B24D 7/14; B24D 99/00; B24D 99/005; B24D 11/003; B24D 11/06; B24D 13/04; B24D 13/14; B24D 13/145; B24D 13/147; B24D 13/16; B24D 15/023; B24D 15/08; B24D 15/082; B24D 18/0018; B24D 18/0054; B24D 3/00; B24D 3/08; B24D 3/10; B24D 3/007; B24D 3/342; B24D 3/346; B24D 7/00; B24D 5/06; B24D 5/14; B24D 7/02; B24D 7/04; B24D 7/066; B24D 7/16; B24D 9/08; B24D 9/085

See application file for complete search history.

(56) References Cited

U.S. PATENT DOCUMENTS

| | | | | |
|---|---|---|---|---|
| 5,891,206 | A * | 4/1999 | Ellingson | B24B 13/01 451/12 |
| 6,093,092 | A | 7/2000 | Ramanath et al. | |
| 6,102,789 | A | 8/2000 | Ramanath et al. | |
| 2014/0187124 | A1* | 7/2014 | Ramanath | B24D 5/00 451/28 |

FOREIGN PATENT DOCUMENTS

EP 0945220 A1 9/1999

OTHER PUBLICATIONS

International Search Report and Written Opinion, dated Nov. 20, 2018, from corresponding PCT application No. PCT/IB2018/055554.

* cited by examiner

*Primary Examiner* — Pegah Parvini
(74) *Attorney, Agent, or Firm* — Nixon & Vanderhye

(57) ABSTRACT

Disclosed is a process for making a grinding wheel for the squaring of ceramic, formed by a support body and an abrasive ring. The process does not involve costly workings on the body and on the ring and produces a light grinding wheel which, therefore, is more practical to be handled by the handling machine.

20 Claims, No Drawings

PROCESS FOR MAKING A DIAMOND TOOL

BACKGROUND OF THE INVENTION

Field of the Invention

The present invention refers, in general, to a process for making a diamond tool for the working of ceramic. More particularly, the present invention refers to a process for making a grinding wheel for the squaring of ceramic.

Description of the Related Art

As is known, the several tools used to work ceramic articles include grinding wheels for the squaring. Said grinding wheels comprise a metal diamond band, namely a most external abrasive band which acts on the article to be worked.

At present, in order to make said grinding wheels lighter so as not to stress the machines to which said grinding machines are fixed for their handling, the external metal band is sintered on an iron ring which is then coupled to a support aluminum body, as explained below.

The present grinding wheels for the dry working of ceramic include an external abrasive band comprising a conventional binder based on copper and other powders, such as iron, nickel, cobalt, silicon, as well as the super-abrasives. The external band is usually sintered directly on iron bodies, copper-iron bodies, or on iron bodies by interposing a layer of compatible powder, called "foot" between the body and the most external abrasive band.

Owing to a chemical incompatibility and substantial differences of sintering and fusion temperatures between the conventional alloys and aluminum, it is not possible to sinter the conventional metal alloys directly on aluminum bodies, which would make the grinding wheel event lighter.

Hence, it is not possible at present to obtain an abrasive band fixed by sintering to an aluminum body.

In order to obviate this problem and to produce an even lighter grinding wheel, it is usual to produce double-body grinding wheels: it is sufficient to sinter conventional alloys on an iron or copper-iron support ring so as to create an abrasive ring which is then anchored by means of screws to an aluminum body.

However, this process involves higher production costs owing to a higher number of working steps. In fact, in the iron support ring it is necessary to form, for example, knurlings, holes, and/or inclined grooves that are to form undercuts with function of mechanical coupling between ring and sintered band. Then, the aluminum body must be coupled to the iron ring and fixed, for example, by means of screws.

Besides, this procedure provides, in any case, the use of an iron ring, which does not allow to minimize the weight.

In addition, the absence of continuity between the most external ring and the internal body limits the properties of heat dispersions which would be appreciated when the grinding wheel is utilized.

SUMMARY OF THE INVENTION

An object of the invention is to obviate the above mentioned inconveniences and still others by carrying out a process for making a diamond tool, in particular a grinding wheel for working ceramic, which is structurally simple and does not need several complex workings.

Another object of the invention is to provide a process for making a light diamond tool so as to reduce the stress on the machine on which the diamond tool is mounted and facilitate the operations of transport and montage.

Another object of the invention is to provide a process for making a diamond tool, in particular a grinding wheel, which works at lower temperatures with respect to the conventional grinding wheels and to the double-body grinding wheels.

The above mentioned objects and others are reached according to the invention through a process for making a diamond tool, preferably a grinding wheel for ceramic processing, said tool comprising a support body for fastening the tool to a machine, an abrasive layer that abrades the ceramic, and an interface layer for connecting the abrasive layer to the support body.

Below, the term "grinding wheel" or "grinding wheels" is to be intended as a substitutive term of "tool" or "tools".

In particular, the process according to the invention is characterized by the fact of comprising the following steps:

- placing an aluminum ring-shaped support body inside a steel mold having the same shape and dimensions of the support body;
- placing a mixture of interface powders inside the mold and above the support body so as to obtain the interface layer of the tool;
- placing a mixture of abrasive powders inside the mold and above the mixture of interface powders so as to obtain the abrasive layer of the tool;
- putting on top under pressure the mixture of abrasive powders and, consequently, the mixture of interface powders by means of a punch;
- simultaneously with pressure action, heating the mold contents at a temperature between 580° C. and 650° C. for a time between 15 min. and 60 min.

The mixture of interface powders comprises (percentages by weight):

- i) at least 12%, preferably from 15% to 75%, more preferably from 15% to 70% of aluminum powder,
- ii) from 0 to 2.5%, preferably from 0.5% to 2% of a lubricant,
- iii) at least one powder component selected from the following substances: copper, magnesium, silicon and zinc or mixtures thereof.

Said component (iii) is a metal in the elementary state.

Preferably, the component (iii) of the mixture of interface powders is present either as substance of an only type or as mixture of two or more of the above mentioned substances, in an amount of at least 5%, preferably at least 10%, more preferably at least 20%, even more preferably at least 25% by weight. In the mixture of interface powders, the component (iii) is present preferably, in a maximum amount of 88%, more preferably 85% by weight.

Preferably, the component (iii) is a mixture. Advantageously, in the mixture of interface powders, the following substances can be included in the indicated amounts (percentages by weight):

- from 0 to 2.5%, preferably from 0.2% to 1% of magnesium;
- from 0 to 15%, preferably from 0.2% to 10% of silicon;
- from 0 to 7%, preferably from 0.2% to 1% of zinc.

Copper is the preferred substance as component (iii).

More preferably, the component (iii) is a mixture including (percentages by weight):

- from 80% to 99.5% of copper;
- from 0.2% to 1.5% of magnesium;
- from 0.3% to 1.5% of silicon;
- from 0 to 1.5% of zinc.

In particular, the mixture of abrasive powders comprises (percentages by weight):

I) 85% and 95%, preferably 88-95% of a copper-base mixture, and

II) 5% and 15%, preferably 5-12% of a secondary mixture.

The secondary mixture includes (percentages by weight):

A more than 70%, more preferably more than 75% of aluminum powder,

B from 0 to 2.5%, preferably from 0.5% to 2% of a lubricant,

C at least one powder component selected from the following substances: copper, magnesium, silicon and zinc or alloys thereof.

Said component (C) is a metal in the elementary state.

Preferably, the component (C) of the secondary mixture is present either as substance of an only type or as a mixture of two or more of the above-mentioned substances, in an amount of at least 0.5%, preferably at least 1%, more preferably at least 3% by weight. In the secondary mixture, the component (C) is present, preferably, in a maximum amount of 25%, more preferably 22% by weight.

Preferably, the component (C) is a mixture. Advantageously, in the secondary mixture, the following substances can be included in the indicated amounts (percentages by weight):

from 0 to 35%, preferably from 0.1% to 10% of copper;

from 0 to 2.5%, preferably from 0.2% to 2.5% of magnesium;

from 0 to 15%, preferably from 0.2% to 10% of silicon;

from 0 to 7%, preferably from 0 to 5% of zinc.

Silicon is the preferred substance as component (C).

Even more preferably, the component (C) is a mixture comprising (percentages by weight):

from 10% to 90%, preferably from 10% to 85% of copper;

from 1.5% to 70%, preferably from 2% to 65% of magnesium;

from 5% to 90%, more preferably from 5% to 85% of silicon;

from 0 to 1.5% of zinc.

The copper-based mixture is of a known type and comprises the following components (percentages by weight):

a) more than 50% of copper;

b) from 0 to 30% of iron;

c) from 5% to 25% of tin;

d) from 0 to 20% of graphite.

Preferably, the copper-based mixture according to the embodiment of the invention as described here comprises (percentages by weight):

from 60% to 80% of copper;

from 10% to 20% of iron;

from 10% to 20% of tin;

from 0.5% to 2% of graphite.

Through the previously defined amounts of metals inside the mixtures, it is possible to lower the sintering temperatures so that it is possible to avoid a damage to the aluminum support body that would risk to melt and flow out of the mold in the pressing step.

Advantageously, the mixture of interface powders can be arranged in the inside of the mold and on the upper part of the support body for a thickness of 0.5-2 mm, preferably about 1±0.2 mm so as to ensure its function of interconnection between abrasive layer and support body and, at the same time, not to burden the whole weight of the grinding wheel.

For an optimal result of the grinding wheel, the mixture of interface powders and the mixture of abrasion powders con be put under pressure and, at the same time, brought to a temperature between 580 and 650° C., preferably between 600 and 640° C. for a time between 15 and 60 minutes, preferably between 20 and 50 minutes, for example specifically at a temperature of 620° C. for a time of 30 minutes.

Hence, the process according to the invention, which process is to produce a diamond tool, does not provide costly workings on the body and ring, as those provided by the prior art, to create a mechanical system of mutual clasping.

Besides, through the process according to the invention, the so-obtained tool, in particular a grinding wheel, weighs about half in comparison to a conventional tool, and about a third less than a double-body tool. The reduced weight involves a substantial reduction of the stress on the mechanics of the machine, with minor problems of breakage and upkeep.

Moreover, the process according to the invention allows to obtain tools having optimal properties of heat dispersion because said copper-based tools, sintered directly on an aluminum body, work at temperatures lower than the conventional grinding wheels and double-body grinding wheels.

In general terms, the tool obtained through the process according to the invention provides a support body and an abrasive layer, an interface layer being arranged between the support body and the abrasive layer to fix the abrasive layer to the support body.

A process for making a grinding wheel provides at first to choose an aluminum body acting as support and connection to the machine.

The aluminum support body used in the process is of a known type. It is a ring-shaped body having an external diameter between 100 mm and 350 mm corresponding to the final external diameter of the so-obtained grinding wheel, and a thickness of at least 8 mm which is sufficient to form the threaded holes which are necessary for the connection to the machine putting the so-obtained grinding wheel in rotation.

The aluminum support body is arranged on the bottom of a steel mold. In addition to steel molds, also graphite molds can be used, in particular when the pressing-sintering process is utilized.

Inside the mold, on the upper part of the aluminum body, a mixture of interface powders for a thickness of 1 mm is arranged to obtain the interface layer.

Besides, superiorly to the mixture of interface powders, a mixture of abrasion powders is arranged to obtain the abrasive layer.

Then, the mold is closed by means of a punch which puts the two layers, formed by the two mixtures, under pressure so as to compact the powders on the aluminum body.

In this way, the abrasive layer of the grinding wheel is formed and at the same time, the interface layer allows to fix the same abrasive layer to the support body so as to obtain a single-body grinding wheel.

In general, the powder mixtures can be sintered together with the aluminum support body at a temperature between 580° C. and 650° C., for a time between 15 and 60 minutes, the sintering taking place in free atmosphere or pure nitrogen.

In order to sinter the metal part on aluminum bodies, the sintering temperature must not exceed 650° C. otherwise the aluminum body would melt in the inside of the mold with a consequent flowing of the metal out of the mold at the time of pressure application.

With these sintering parameters, the mixture of interface powders ensures an optimal metallurgic and chemical coupling between the aluminum support body and the abrasive layer.

The process for the preparation of the mixture of abrasion powders and mixture of interface powders to be inserted in the mold is described below.

The process for the preparation of the mixture of interface powders comprises to mix together all the components of the mixture operating at a temperature between 20° C. and 25° C., preferably between 22° C. and 24° C., at atmospheric pressure without inert gas.

The mixing is performed in a turbo mixer with speed between 15 and 44 rpm, preferably between 20 and 40 rpm, for a period of time between 42 and 48 minutes, preferably between 44 and 46 minutes.

Alternatively to the turbo mixer, it is possible to use an orbital mixer, at a speed between 80 and 400 rpm, preferably between 150 and 300 rpm, for a period of time between 20 and 30 minutes, preferably between 23 and 27 minutes.

All the components can be added at the same time or in succession, the order of addition being not relevant.

The process for the preparation of the secondary mixture comprises mixing together all the components that will form the mixture operating at a temperature between 20° C. and 25° C., preferably between 22° C. and 24° C., at atmospheric pressure without inert gas.

The mixing is carried out in a turbo mixer, with speeds between 15 and 44 rpm, preferably between 20 and 40 rpm, for a period of time between 42 and 48 minutes, preferably between 44 and 46 minutes.

Alternatively to the turbo mixer, it is possible to use an orbital mixer at a speed between 80 and 400 rpm, preferably between 150 and 300 rpm, for a period of time between 20 and 30 minutes, preferably between 23 and 27 minutes.

The components can added at the same time or in succession, the order of addition being not relevant.

According to an alternative embodiment, the mixture of interface powders can be obtained by mixing the secondary mixture according to the present invention with the above mentioned component (iii), preferably copper powder. Preferably from 15% to 85% by weight of said secondary mixture is mixed with 15% to 85% by weight of the component (iii), preferably copper powder. The mixing conditions are the same as those described above as concerns the preparation of the mixture of interface powders.

The mixture of abrasion powders is obtained by mixing a copper-based mixture as those of known type that are usually used to obtain a copper-based grinding wheel, with the secondary mixture according to the present invention.

According to a preferred embodiment, the process for the preparation of the mixture of abrasion powders comprises mixing together the two components that will form the mixture operating at a temperature between 20° C. and 25° C., preferably between 22° C. and 24° C., at atmospheric pressure without inert gas.

The mixing is performed in a turbo mixer at a speed between 15 and 44 rpm, preferably between 20 and 40 rpm, for a period of time between 42 and 48 minutes, preferably between 44 and 46 minutes.

Alternatively to the turbo mixer, it is possible to use an orbital mixer, at a speed between 80 and 400 rpm, preferably between 150 and 300 rpm, for a period of time between 20 and 30 minutes, preferably between 23 and 27 minutes.

All the components can be added at the same time or in succession, the order of addition being not relevant.

The copper mixture is a mixture known in the art. Generally, this mixture is prepared by mixing together all the components that will form the mixture operating at a temperature between 20° C. and 25° C., preferably between 22° C. and 24° C., at atmospheric pressure without inert gas.

The mixing is performed in a turbo mixer at a speed between 15 and 44 rpm, preferably between 20 and 40 rpm, for a period of time between 42 and 48 minutes, preferably between 44 and 46 minutes.

Alternatively to the turbo mixer it is possible to use an orbital mixer at a speed between 80 and 400 rpm, preferably between 150 and 300 rpm, for a period of time between 20 and 30 minutes, preferably between 23 and 27 minutes.

All the components can be added at the same time or in succession, the order of addition being not relevant.

Said mixtures of known type are arranged according to their order into the mold and here, the mixtures are usually heated at temperatures between 700° C. and 780° C.

The mixture of abrasion powders comprising also the secondary mixture according to the present invention allows to perform a process in which the sintering temperature is lower than the processes of known art in which the mixture of abrasion powders does not include said secondary mixture.

Further features and details of the invention will be better understood from the description of the following examples that are provided by way of non-limiting examples.

DESCRIPTION OF THE PREFERRED EMBODIMENTS

Examples 1-4—Preparation of the Secondary Mixture

A secondary mixture is prepared by mixing the components that will form the secondary mixture in a turbo mixer, at a speed of 23 rpm for 45 minutes.

The mixing takes place at a temperature of 22° C., at atmospheric pressure without inert gas.

In the following Table 1, the percentages by weight of the components of the obtained secondary mixtures are reported.

TABLE 1

| Example | 1-Mix 1 | 2-Mix 2 | 3-Mix 3 | 4-Mix 4 |
|---|---|---|---|---|
| % by weight of aluminum | 92.9 | 96.8 | 88.3 | 80.3 |
| % by weight of copper | 4.5 | 0.2 | 1.7 | 2.6 |
| % by weight of magnesium | 0.5 | 1.0 | 2.5 | 0.6 |
| % by weight of silicon | 0.6 | 0.5 | 6.0 | 15.0 |
| % by weight of lubricant | 1.5 | 1.5 | 1.5 | 1.5 |

Example 5—Preparation of the Mixture of Abrasion Powders

A mixture of abrasion powders is prepared so as to obtain the abrasive layer by mixing, for each mixture, 10 parts by weight of the secondary mixture of Example 1 with 90 parts by weight of the copper-based mixture of known type, the copper-based mixture having the following composition (percentages by weight):

70% of copper;
15% of iron;
14% of tin;
1% of graphite.

The two components forming the mixture are poured into a mixer, at first the component in greater quantity and then, the other component. The mixing is performed in an orbital mixer at a speed of 250 rpm, for 25 minutes.

The mixing takes place at a temperature of 23° C., at atmospheric pressure without inert gas.

Examples 6-8—Preparation of the Mixture of Abrasion Powders

The example 5 is repeated with the difference that instead of the mixture of Example 1, the mixtures of Examples 2 to 4 are utilized for each example.

Examples 9 and 10—Preparation of the Mixture of Interface Powders

A mixture of interface powders (MIX A and MIX B) is prepared to obtain the interface layer and to be utilized in the embodiment of the invention described here. This mixture is obtained by mixing the mixture Mix 1 obtained in the Example 1 with an appropriate amount of copper powder. The ratios by weight as used between the two components are reported in the following Table 2.

The two components forming the mixture are poured into a mixer, at first the component in greater quantity and then, the other component. The mixing is performed in a turbo mixer at a speed of 23 rpm for 45 minutes.

The mixing takes place at a temperature of 22° C., at atmospheric pressure without inert gas.

In the following Table 2, the percentages by weight of the components of the obtained mixtures are reported.

TABLE 2

| Example | 9-Mix A | 10-Mix B |
|---|---|---|
| Mix 1 Ratio: copper powder (by weight) | 70:30 | 20:80 |
| Composition of the obtained mixture | | |
| % by weight of aluminum | 65.00 | 18.00 |
| % by weight of copper | 32.73 | 79.4 |
| % by weight of magnesium | 0.35 | 0.5 |
| % by weight of silicon | 0.42 | 0.6 |
| % by weight of lubricant | 1.5 | 1.5 |

Example 11: Sintering Processes

In order to create a coupling of metallurgic/chemical type between the aluminum body and the mixture of abrasion powder (formed by the copper-based mixture with the addition of the secondary mixture) of the Example 5, a layer of 1 mm of a mixture of interface powders produced in the Example 9 is interposed.

The layer of the mixture of abrasion powder has a double thickness in comparison to the final thickness, obtained at the end of the process.

Then, the sintering of the mixture of abrasion powders is performed by exerting a pressure on the double layer of the mixture by means of a punch and, at the same time, the two layers are brought, together with the aluminum body itself, to a temperature of 620° C. for a time of 30 minutes.

Example 12-17—Sintering Processes

The example 11 is repeated by utilizing, instead of the mixture of abrasion powder of the Example 5, the mixtures of the Examples 6 to 8 with the mixture of interface powders produced in the Example 9 or in the Example 10, respectively.

All the processes according to the present invention, carried out in the examples have produced a grinding wheel with a satisfactory connection between the aluminum support body and the diamond abrasion layer although the process has been performed at a temperature lower than the temperatures usually used according to prior art.

For this reason, peculiar characteristic of the invention is the use of quantities of metals capable of lowering the sintering temperature of the copper-based metal part and using a layer of powder acting as an interface for a metallurgic/chemical connection between the aluminum support body and the diamond abrasion layer.

A technician of the sector can insert modifications or variants that are to be considered as included in the scope of protection of the present invention.

The invention claimed is:

1. Process for making a diamond tool for ceramic processing, said tool comprising:
- a support body for fastening the tool to a machine,
- an abrasive layer that abrades the ceramic,
- an interface layer for connecting the abrasive layer to the support body, said process comprising the following steps:
- placing an aluminum ring-shaped support body inside a steel mold having the same shape and dimensions of the support body;
- placing a mixture of interface powders inside the mold and above the support body so as to obtain the interface layer of the tool;
- placing a mixture of abrasive powders inside the mold and above the mixture of interface powders so as to obtain the abrasive layer of the tool;
- putting on top under pressure the mixture of abrasive powders and, consequently, the mixture of interface powders by means of a punch;
- simultaneously with pressure action, heating the mold contents at a temperature between 580° C. and 650° C. for a time between 15 min. and 60 min.;

in which the mixture of interface powders includes the following components (percentages by weight):
- i) at least 12% of aluminum powder,
- ii) from 0 to 2.5% of an interface powder lubricant,
- iii) at least one powder component selected from the following substances: copper, magnesium, silicon and zinc or mixtures thereof; and in which the mixture of abrasion powders includes the following components (percentages by weight):
- I) between 85% and 95% of a copper-based mixture, this mixture including the following components (percentages by weight):
  - a) at least 50% of copper;
  - b) less than 30% of iron;
  - c) between 5% and 25% of tin;
  - d) less than 20% of graphite;
- II) between 5% and 15% of a secondary mixture, this secondary mixture including the following components (percentages by weight):

A) more than 70% of aluminum powder,
B) from 0 to 2.5% of a secondary mixture lubricant,
C) at least one powder component selected from the following substances: copper, magnesium, silicon and zinc or mixtures thereof.

2. Process according to claim 1, wherein the mixture of interface powders includes (percentages by weight):
i) from 15% to 75%, of aluminum powder,
ii) from 0.5% to 2% of the interface powder lubricant,
iii) at least one powder component selected from the following substances:
copper, magnesium, silicon, zinc or mixtures thereof.

3. Process according to claim 1, wherein the secondary mixture includes the following components (percentages by weight):
A) from 75% of aluminum powder,
B) from 0.5% to 2% of the secondary mixture lubricant,
C) at least one powder component selected from the following substances: copper, magnesium, silicon, zinc or mixtures thereof.

4. Process according to claim 1, wherein the mixture of interface powders is placed inside the mold and above the support body for a thickness of 0.5-2 mm.

5. Process according to claim 1, wherein the mixture of interface powders and the mixture of abrasion powders are put under pressure and are brought at the same time at a temperature of 600° C. to 640° C. for a time between 20 and 50 minutes.

6. Process according to claim 1, wherein the secondary mixture includes:
aluminum in an amount of 92.9% by weight;
copper in an amount of 4.5% by weight;
magnesium in an amount of 0.5% by weight;
silicon in an amount of 0.6% by weight;
from 1.5% of the secondary mixture lubricant.

7. Process according to claim 1, wherein the secondary mixture includes:
aluminum in an amount of 96.8% by weight;
copper in an amount of 0.2% by weight;
magnesium in an amount of 1% by weight;
silicon in an amount of 0.5% by weight;
lubricant in an amount of 1.5% by weight.

8. Process according to claim 1, wherein the secondary mixture includes:
aluminum in an amount of 88.3% by weight;
copper in an amount of 1.7% by weight;
magnesium in an amount of 2.5% by weight;
zinc in an amount of 6% by weight;
lubricant in an amount of 1.5% by weight.

9. Process according to claim 1, wherein the secondary mixture includes:
aluminum in an amount of 80.3% by weight;
copper in an amount of 2.6% by weight;
magnesium in an amount of 0.6% by weight;
silicon in an amount of 15% by weight;
lubricant in an amount of 1.5% by weight.

10. Process according to claim 1, wherein the mixture of interface powders includes:
aluminum in an amount of 65.00% by weight;
copper in an amount of 32.73% by weight;
magnesium in an amount of 0.35% by weight;
silicon in an amount of 0.42% by weight;
lubricant in an amount of 1.5% by weight.

11. Process according to claim 1, wherein the mixture of interface powders includes:
aluminum in an amount of 18.00% by weight;
copper in an amount of 79.4% by weight;
magnesium in an amount of 0.5% by weight;
silicon in an amount of 0.6% by weight;
lubricant in an amount of 1.5% by weight.

12. Process according to claim 1, wherein the copper-based mixture includes (percentages by weight):
from 65% to 75% of copper;
from 10% to 20% of iron;
from 10% to 18% of tin;
from 0.5% to 1.5% of graphite.

13. Process according to claim 2, wherein the secondary mixture includes the following components (percentages by weight):
D) from 75% of aluminum powder,
E) from 0.5% to 2% of the secondary mixture lubricant,
at least one powder component selected from the following substances: copper, magnesium, silicon, zinc or mixtures thereof.

14. Process according to claim 2, wherein the mixture of interface powders is placed inside the mold and above the support body for a thickness of 0.5-2 mm.

15. Process according to claim 3, wherein the mixture of interface powders is placed inside the mold and above the support body for a thickness of 0.5-2 mm.

16. Process according to claim 2, wherein the mixture of interface powders and the mixture of abrasion powders are put under pressure and are brought at the same time at a temperature of 600° C. to 640° C. for a time between 20 and 50 minutes.

17. Process according to claim 3, wherein the mixture of interface powders and the mixture of abrasion powders are put under pressure and are brought at the same time at a temperature of 600° C. to 640° C. for a time between 20 and 50 minutes.

18. Process according to claim 4, wherein the mixture of interface powders and the mixture of abrasion powders are put under pressure and are brought at the same time at a temperature of 600° C. to 640° C. for a time between 20 and 50 minutes.

19. Process according to claim 2, wherein the secondary mixture includes:
aluminum in an amount of 92.9% by weight;
copper in an amount of 4.5% by weight;
magnesium in an amount of 0.5% by weight;
silicon in an amount of 0.6% by weight;
from 1.5% of the secondary mixture lubricant.

20. Process according to claim 3, wherein the secondary mixture includes:
aluminum in an amount of 92.9% by weight;
copper in an amount of 4.5% by weight;
magnesium in an amount of 0.5% by weight;
silicon in an amount of 0.6% by weight;
from 1.5% of the secondary mixture lubricant.

* * * * *